US012654820B2

(12) United States Patent
Smith et al.

(10) Patent No.: US 12,654,820 B2
(45) Date of Patent: Jun. 16, 2026

(54) SYSTEM AND METHOD TO TRANSPORT WATERCRAFT

(71) Applicants: Samuel I Smith, Allendale Charter Township, MI (US); Craig Martin Oomen, Lowell, MI (US)

(72) Inventors: Samuel I Smith, Allendale Charter Township, MI (US); Craig Martin Oomen, Lowell, MI (US)

( * ) Notice: Subject to any disclaimer, the term of this patent is extended or adjusted under 35 U.S.C. 154(b) by 285 days.

(21) Appl. No.: 18/240,733

(22) Filed: Aug. 31, 2023

(65) Prior Publication Data

US 2024/0067310 A1 Feb. 29, 2024

Related U.S. Application Data

(60) Provisional application No. 63/402,799, filed on Aug. 31, 2022.

(51) Int. Cl.
*B63B 34/60* (2020.01)
*B63B 34/26* (2020.01)

(52) U.S. Cl.
CPC ..... *B63B 34/60* (2020.02); *B63B 34/26* (2020.02)

(58) Field of Classification Search
CPC ..... B60B 34/60; B60B 34/26
USPC ..... 280/64
See application file for complete search history.

(56) References Cited

U.S. PATENT DOCUMENTS 2,683,268 A * 7/1954 Strayer ..... B63C 13/00 280/47.3
2,831,203 A * 4/1958 Kanarr ..... B63C 13/00 114/344
5,975,003 A 11/1999 Manson
6,189,478 B1 * 2/2001 Myers ..... B63C 13/00 114/344
6,189,900 B1 2/2001 MacDonald
6,824,155 B1 * 11/2004 Heck ..... B63C 13/00 114/344
7,398,983 B2 * 7/2008 Van Den Engel ..... A01B 73/00 280/104
7,527,013 B2 * 5/2009 Bramson ..... B63C 13/00 114/344
8,091,501 B2 * 1/2012 Lazarevic ..... B63C 13/00 114/344
8,495,966 B2 7/2013 Lazarevic
8,690,167 B1 4/2014 Huntley et al.
(Continued)

*Primary Examiner* — Hau V Phan
(74) *Attorney, Agent, or Firm* — Dunlap Bennett & Ludwig PLLC

(57) ABSTRACT

The present disclosure discloses an apparatus to move a watercraft from one location to another. The apparatus may include a first tire and a second tire, and a first leg and a second leg. Each leg may include a proximal end and a distal end. The first and second legs may be attached to the first and second tires via respective distal ends. The apparatus may further include a first bracket and a second bracket configured to receive the proximal ends of respective first and second legs. The apparatus further includes a first indexing plate and a second indexing plate which are attached to the first bracket and the second bracket. Further, the apparatus includes first and second pull assemblies configured to engage or disengage with the respective first indexing plate and the second indexing plate to move the apparatus between a stow position and transport position.

10 Claims, 4 Drawing Sheets

(56) References Cited

U.S. PATENT DOCUMENTS

| | | | | |
|---|---|---|---|---|
| 8,945,966 | B2 * | 2/2015 | Francis | C30B 7/005 438/285 |
| 11,027,803 | B1 * | 6/2021 | Brinkley | B63C 13/00 |
| D929,067 | S | 8/2021 | Kowalski | |
| 2013/0104791 | A1 * | 5/2013 | Angelow | B63C 13/00 114/344 |
| 2016/0096602 | A1 | 4/2016 | Nutz et al. | |
| 2022/0185403 | A1 * | 6/2022 | Listro | B63C 13/00 |
| 2023/0192252 | A1 * | 6/2023 | Schricker | B63C 13/00 114/344 |

* cited by examiner

SYSTEM AND METHOD TO TRANSPORT WATERCRAFT

CROSS-REFERENCE TO RELATED APPLICATION

This application claims the benefit of priority of U.S. provisional application No. 63/402,799, filed Aug. 31, 2022, the contents of which are herein incorporated by reference.

BACKGROUND OF THE INVENTION

Field of the Invention

The present invention generally relates to a watercraft, and more particularly to a system and method to transport watercraft from one location to another.

Description of the Related Art

Watercraft such as kayaks or canoes are used for recreational purposes. A watercraft may be heavy and have large dimensions. For example, the watercraft may include outdoor gear (such as fishing gear, batteries, motors, tackle, coolers) that may increase the overall weight of the watercraft. Therefore, users may find it difficult to move the watercraft from one location to another, for example, from the user's home to an activity area.

Accordingly, there is a need for an apparatus that assists the user to conveniently transport the watercraft from one location to another.

Embodiments of the present disclosure provide for a novel apparatus to transport watercraft, as described and defined in the description below and in the annexed claims that provide convenience to the users to transport watercraft.

SUMMARY OF THE INVENTION

The following presents a simplified summary of the present disclosure in a simplified form as a prelude to the more detailed description that is presented herein.

In accordance with embodiments of the invention, there is provided an apparatus to move a watercraft from one location to another. The apparatus may include a first tire and a second tire, and a first leg and a second leg. Each leg may include a proximal end and a distal end. The first and second legs may be attached to the first and second tires via respective distal ends. The apparatus may further include a first bracket and a second bracket configured to receive the proximal ends of respective first and second legs. The apparatus further includes a first indexing plate and a second indexing plate which are attached to the first bracket and the second bracket. Further, the apparatus includes first and second pull assemblies configured to engage or disengage with the respective first indexing plate and the second indexing plate to move the apparatus between a stow position and transport position.

In some aspects, each of the first pull pin assembly and the second pull assembly includes a pull pin, a spring, and a pull pin housing. In further aspects, each of the first indexing plate and the second indexing plate includes one or more holes configured to receive the pull pin.

In some aspects, the apparatus may include a cable disposed between the first pull pin assembly and the second pull pin assembly. The cable may be configured to engage or disengage the pull pin with the one or more holes, which enables the apparatus to move between the stow position and the transport position. In some aspects, the cable may be inserted in a receiving hole of the pull pin.

The present disclosure discloses a transport apparatus that may facilitate a user to move a watercraft conveniently from one location to another. The transport apparatus may be easily engaged or disengaged with the watercraft. In addition, the transport apparatus may be moved between a stow position and a transport position by engaging and disengaging the pull pins with the indexing plate. The transport apparatus may also have the ability to attach with a strap system to remove the stress on the watercraft when subjected to a hanging load during transportation. This gives the user less risk of damaging the water vessel.

These and other features, aspects, and advantages of the present invention will become better understood with reference to the following description and appended claims.

BRIEF DESCRIPTION OF THE DRAWINGS

Illustrative embodiments of the present invention are described herein with reference to the accompanying drawings, in which.

DETAILED DESCRIPTION OF INVENTION

Figure 1:
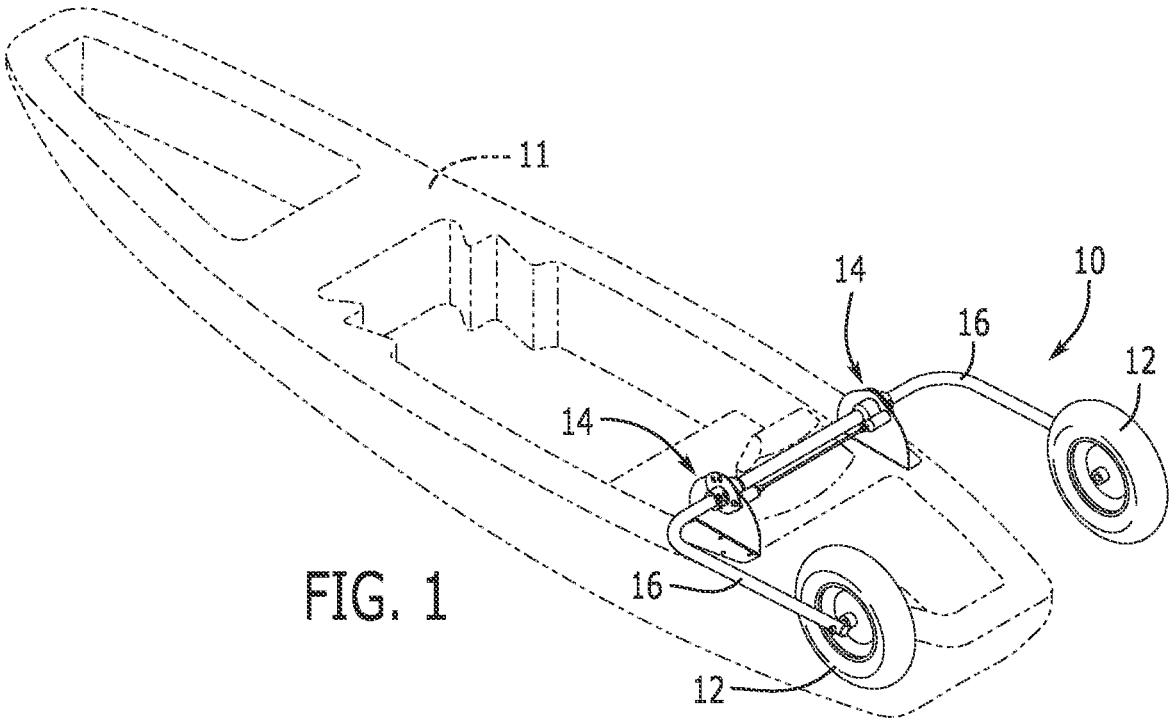
FIG. 1 depicts an example environment in which techniques and structures for providing the systems and methods disclosed herein may be implemented.

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

Reference will now be made in detail to the present preferred embodiments of the invention, examples of which are illustrated in the accompanying drawings. Wherever possible, the same reference numerals are used in the drawings and the description to refer to the same or like parts.

FIG. 1 depicts an example environment in which techniques and structures for providing the systems and methods disclosed herein may be implemented. The environment may include an articulating tire assembly 10 (hereinafter referred to as a transport apparatus 10) for a watercraft 11.

The watercraft 11 may be, for example, a kayak, a canoe, a dinghy, a paddleboard, and/or the like. In an exemplary aspect, the watercraft 11 may be a conventional kayak that may be made of plastic, fiberglass, polyethylene, Kevlar, a combination thereof, and/or any other similar material. The transport apparatus 10 may be attached to the watercraft 11, which may facilitate a user to move the watercraft 11 from one location to another. In some aspects, the transport apparatus 10 may be removably attached to the watercraft 11. In further aspects, the transport apparatus 10 may be attached on a rear portion of the watercraft 11. Alternatively, the transport apparatus 10 may be attached to any other portion of the watercraft 11. In some aspects, the transport apparatus 10 may be made of stainless steel and aluminum grades.

The transport apparatus 10 may include two tires/wheels 12 (e.g., a first tire and a second tire), two bracket assemblies 14 (e.g., a first bracket assembly and a second bracket assembly), and two legs 16. The two tires 12 may be attached to the watercraft 11 via the bracket assemblies 14 and the legs 16. The tires 12 may of any size and may enable easy movement of the watercraft 11. The tires 12 may be attached to the legs 16. For example, a first leg may be attached to a first tire and a second leg may be attached to a second tire (e.g., via tire bushing). In some aspects, the tire bushing may be inserted into axial holes in the legs 16 and then press fit or welded radially. Each of the first leg and the second leg may have an "L-shaped" tube like structure. One end (e.g., a distal end) of each of the first leg and the second leg may be attached to respective tires 12, and another end (e.g., a proximal end) of each of the first leg and the second leg may be attached to the respective bracket assemblies 14. The bracket assemblies 14 may be attached to the watercraft 11 (e.g., to a watercraft top surface). The legs 16 may be configured to move 360 degrees within respective bracket bushing of the bracket assemblies 14. The details of the transport apparatus 10 is described below in conjunction with FIGS. 2-10.

Figure 2:
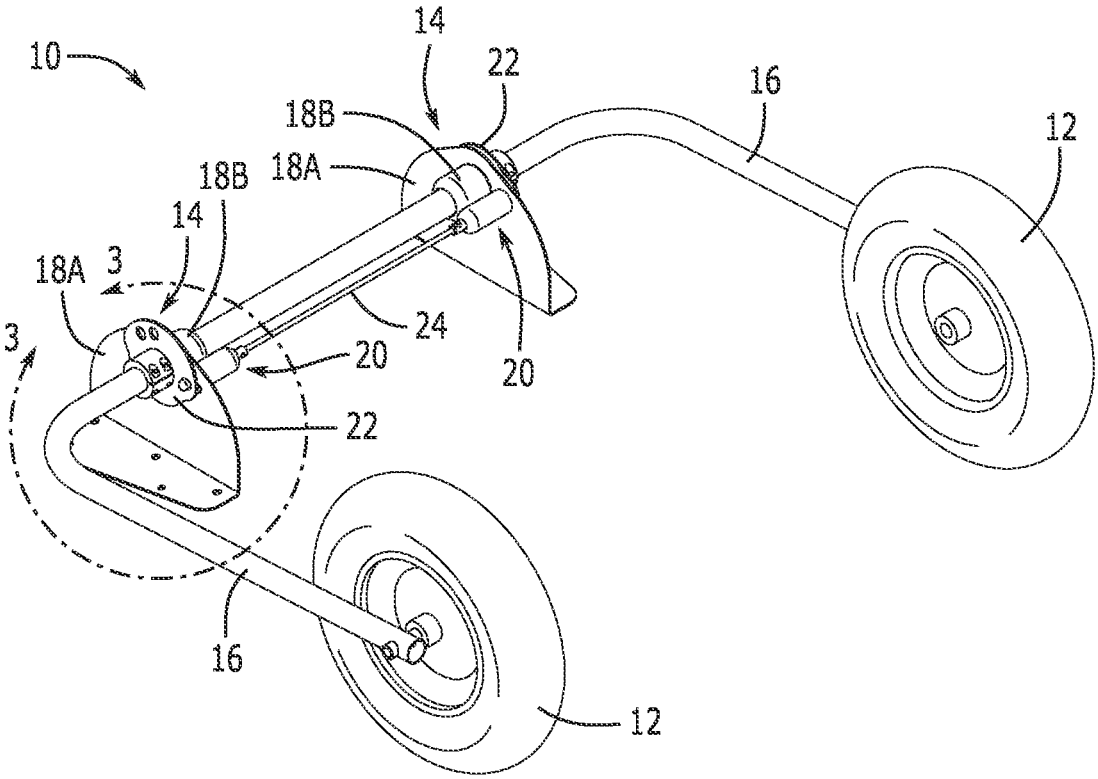
FIG. 2 depicts an enlarged perspective view of bracket assemblies in accordance with the present disclosure.
Figure 3:
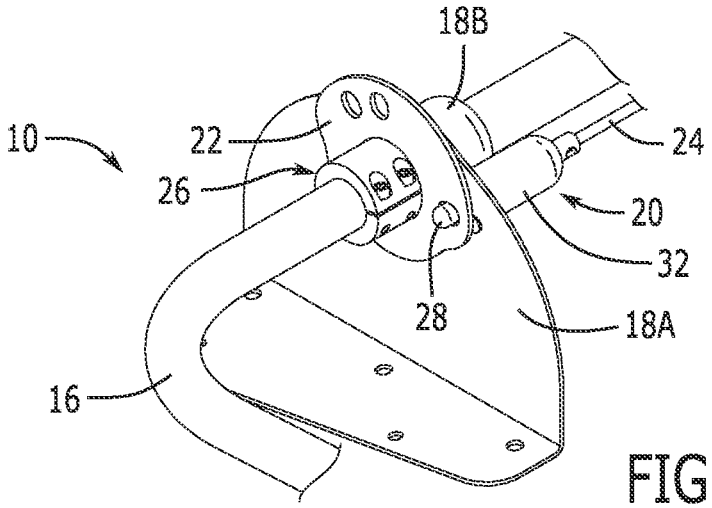
FIG. 3 depicts an enlarged detail perspective view of a stow position taken along line 3-3 in FIG. 2 in accordance with the present disclosure.
Figure 4:
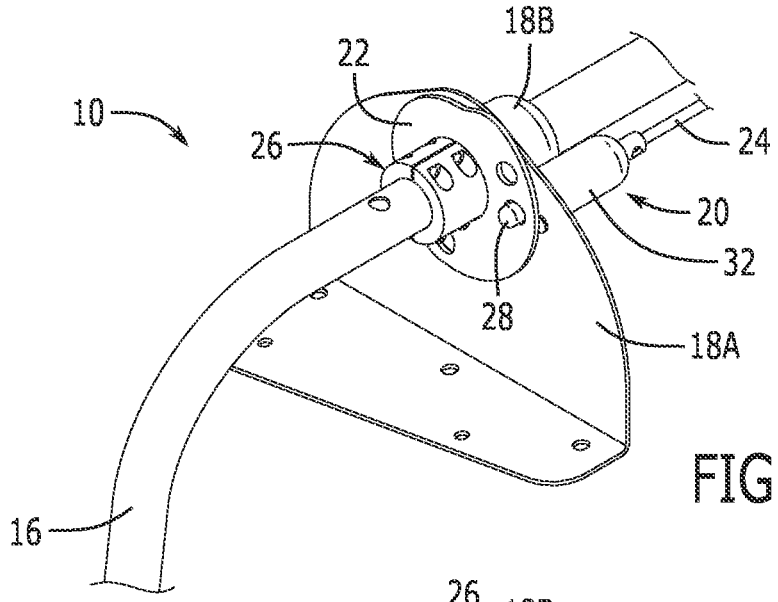
FIG. 4 depicts an enlarged detail perspective view of a first transport position in accordance with the present disclosure.
Figure 5:
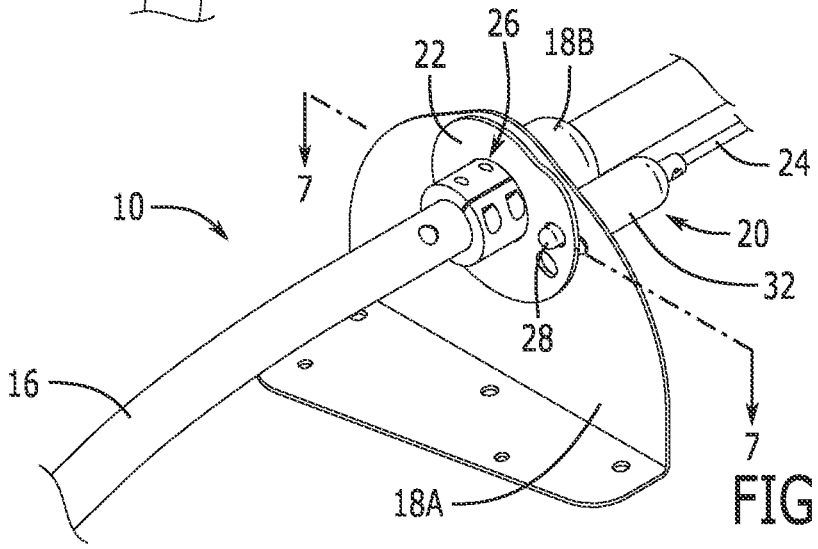
FIG. 5 depicts an enlarged detail perspective view of a second transport position in accordance with the present disclosure.
Figure 6:
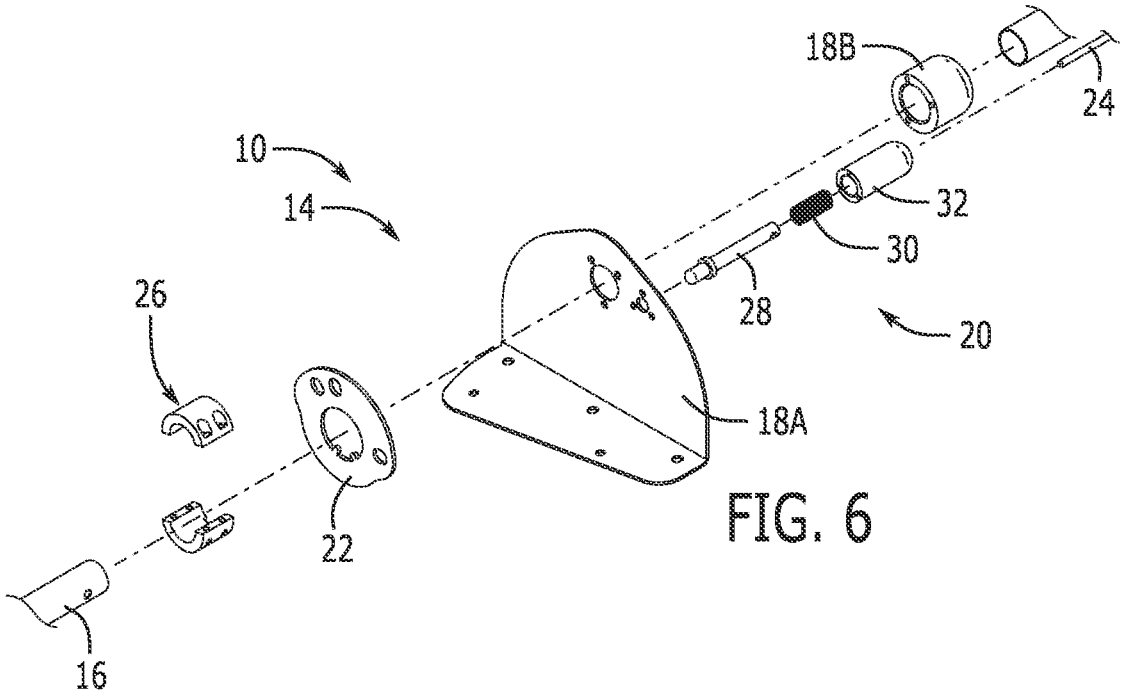
FIG. 6 depicts an exploded perspective view of the parts of a portion of a transport apparatus in accordance with the present disclosure.
Figure 7:
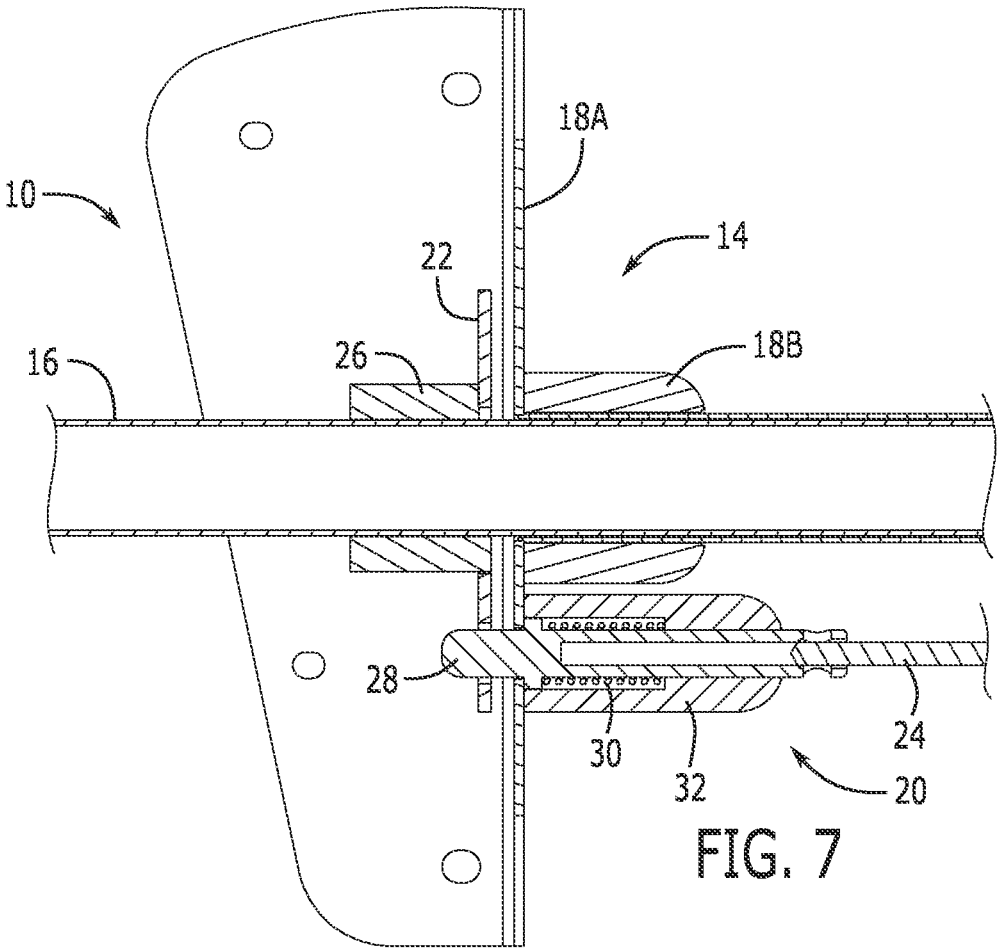
FIG. 7 depicts a cross-sectional view of the portion of the transport apparatus taken along line 7-7 in FIG. 5.
Figure 8:
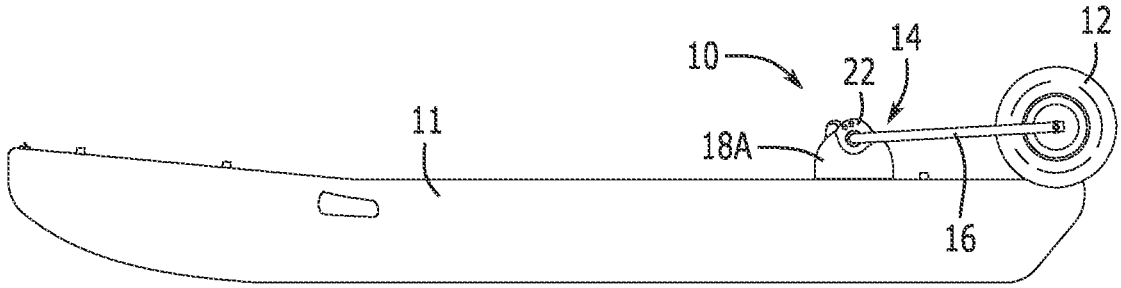
FIG. 8 depicts a side elevation view of the watercraft in a stow position in accordance with the present disclosure.
Figure 9:
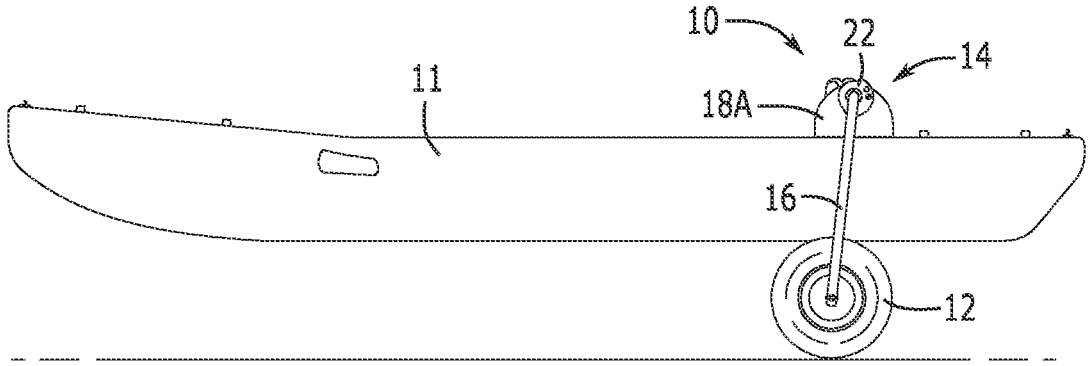
FIG. 9 depicts a side elevation view of the watercraft in a first transport position in accordance with the present disclosure.
Figure 10:
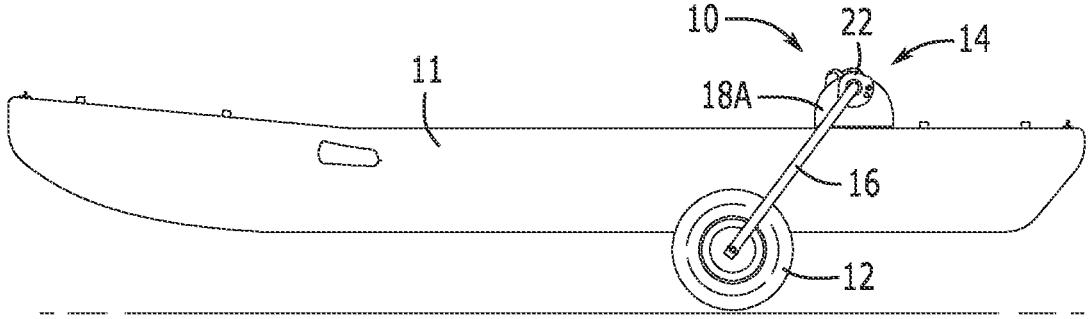
FIG. 10 depicts a side elevation view of the watercraft in a second transport position in accordance with the present disclosure.

FIG. 2 depicts an enlarged perspective view of bracket assemblies (e.g., the bracket assemblies 14) in accordance with the present disclosure. FIG. 2 will be explained in conjunction with FIGS. 3-10. FIG. 3 depicts an enlarged detail perspective view of a stow position. FIG. 4 depicts an enlarged detail perspective view of a first transport position. FIG. 5 depicts an enlarged detail perspective view of a second transport position. FIG. 6 depicts an exploded perspective view of the parts of a portion of a transport apparatus. FIG. 7 depicts a cross-sectional view of the portion of the transport apparatus. FIG. 8 depicts a side elevation view of the watercraft 11 in a stow position. FIG. 9 depicts a side elevation view of the watercraft 11 in a first transport position. FIG. 10 depicts a side elevation view of the watercraft 11 in a second transport position.

In some aspects, the bracket assemblies 14 may be attached to a top surface of the watercraft 11 (e.g., on a periphery of the top surface of the watercraft 11). In further aspects, the bracket assemblies 14 may be attached at a rear portion of the watercraft 11. Alternatively, the bracket assemblies 14 may be attached at any other portion/surface of the watercraft 11. The bracket assemblies 14 may be attached to a metal/aluminum track interface disposed on the watercraft 11. Tracks may be designed to accept hammer screws/drop in T-Nuts (i.e., fastening members). In some aspects, the bracket assemblies 14 may include a plurality of holes which may be aligned with the holes in the track. A user may insert the fastening members through the holes to attach the bracket assemblies 14 to the track.

Each of the bracket assemblies 14 may include a bracket 18A, a bracket bushing 18B, and a pull pin assembly 20. The bracket 18A may include a first plate and a second plate. The first plate may be disposed perpendicular to the second plate. In some aspects, the first plate may be attached to the watercraft 11 (e.g., touches the watercraft 11). The first plate may include holes that may be configured to receive the fastening member. The second plate may also include holes that may be configured to receive the bracket bushing 18B and the pull pin assembly 20. For example, the second plate may include a first hole configured to receive the bracket bushing 18B, and a second hole configured to receive the pull pin assembly 20. In some aspects, the bracket bushing 18B and the pull pin assembly 20 may be removably attached to the bracket 18A (e.g., via screws in conjunction with a concentric through-hole). The bracket bushing 18B and the pull pin assembly 20 may be positioned adjacent to each other. The bracket bushing 18B may be configured to attach the two brackets 18A of the transport apparatus 10.

The pull pin assembly 20 may include a pull pin 28, a spring 30, and a pin housing 32 (as depicted in FIG. 6). The spring 30 may be assembled concentrically to the pull pin 28, and then assembled/inserted into the pin housing 32. The pull pin assembly 20 may be attached to the bracket 18A, via the second hole in the second plate (as described above). In some aspects, a first pull pin assembly may be attached to a first bracket and a second pull pin assembly may be attached to a second bracket. In some aspects, the pull pin assembly 20 may be attached to the bracket 18A via screws encompassing and compressing spring to generate a pull pin action/feature.

The transport apparatus 10 may further include indexing plate assemblies (e.g., a first indexing plate assembly and a second indexing plate assembly). The first indexing plate assembly may be attached to one bracket 18A and the second indexing plate assembly may be attached to another bracket 18A (e.g., to the second plate of the bracket 18A). The pull pin assemblies 20 (e.g., a first pull pin assembly and a second pull pin assembly) may be configured to engage/disengage with respective indexing plate to move the transport apparatus 10 between the stow position and the transport position. Each of the indexing plate assembly may include an indexing plate 22 and a clamping collar 26 (as shown in FIGS. 3-7), which may be attached to each other via screws or welding. The clamping collar 26 may be axially and rotationally constrained by tightening clamping screws generating a clamping force, which may in turn constrain movement of the legs 16 radially with regards to the pull pin 28 and indexing plate 22 positions. In some aspects, the indexing plate 22 may include a center hole that may be configured to receive the legs 16. The clamping collar 26 may be attached to the indexing plate 22, and may be configured to receive the legs 16. In some aspects, the leg 16 may pass through the respective clamping collar 26, the indexing plate 22, and the bracket bushing 18B, as depicted in FIG. 7.

In some aspects, the indexing plate 22 may include a plurality of side holes that may be configured to receive the pull pin 28. For example, the plurality of side holes may include a first side hole, a second side hole, and a third side hole. The pull pin 28 may engage with the first side hole to keep the transport apparatus 10 in a first position (or a stow position when the transport apparatus 10 is not in use) as depicted in FIGS. 3 and 8. The pull pin 28 may engage with the second side hole to keep the transport apparatus 10 in a second position (or a first transport position in which the legs 16 may be disposed approximately perpendicular to the ground) as depicted in FIGS. 4 and 9. The pull pin 28 may engage with the third side hole to keep the transport apparatus 10 in a third position (or a second transport position in which the legs 16 may be disposed at a predefined angle in a range of 20-60 degrees relative to the ground) as depicted in FIGS. 5 and 10. Thus, the transport apparatus 10 may be configured to move between the stow position and the transport position by engaging/disengaging the pull pin 28 with holes of the indexing plate 22.

The transport apparatus 10 may further include a cable 24 that may be connected between the brackets 18A. The cable 24 may be inserted into a receiving hole of the pull pin 28 (as shown in FIG. 7). The cable 24 may then be attached statically to the pull pin 28 via set screws, knots or ferrule. The cable 24 may be configured to engage or disengage the pull pin 28 with the indexing plate 22 (e.g., with the first side hole, the second side hole, and the third side hole on the indexing plate 22). Stated another way, the cable 24 may be configured to move the pull pin 28 between a locked position (in which the pull pin 28 may be inside a side hole) and an unlocked position (in which the pull pin 28 may move away from the indexing plate 22 and may not be inserted in the side hole). The cable 24 may control the pull pin assembly 20 to move the pull pin 28 between the locked position and the unlocked position. Thus, the transport apparatus 10 may be rotated by pulling the cable 24. This may disengage both the pull pins 28 from anti rotation slots in the indexing plate 22. This may allow the user to place the wheel assembly in the desired position, whether stowed or in transport position.

In operation, when the transport apparatus 10 is at a stow position (as depicted in FIGS. 3 and 8), and the user desires to move the watercraft 11, the tires 12 may need to be deployed. To do this, the user may need to pull the cable 24 to compress springs 30 which may dis engage the pull pins 28 from the slots/holes on the indexing plate 22. Once disengaged, the tires 12 may rotate downward. To fully engage the pull pins 28 into the deployed/transport positions (e.g., the first transport position or the second transport position, as depicted in FIGS. 4, 5, 9, and 10), the user may have to slightly lift the stern of the watercraft 11. In some aspects, the transport apparatus 10 may be configured to move automatically between the stow position and transport positions. Additionally, for additional weight requirement for larger watercraft working load conditions a ratchet strap, cord, belt etc. may be fastened to the legs 16 via pre-cut holes or attachment features on the perpendicular surface to the working load. This may generate a clamping force reducing stress on the material of the watercraft 11 by counteracting the hanging load on the assembly.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The claimed invention is:

1. An apparatus for transporting a watercraft, the apparatus comprising:

a first tire and a second tire;

a first leg and a second leg, wherein each leg comprises a proximal end and a distal end, wherein the first leg and the second leg are attached to the first tire and the second tire via respective distal ends;

a first bracket and a second bracket configured to receive the proximal ends of respective first leg and the second leg;

a first indexing plate and a second indexing plate which are attached to the first bracket and the second bracket respectively;

a first pull pin assembly and a second pull pin assembly configured to engage or disengage with the respective first indexing plate and the second indexing plate to move the apparatus between a stow position and at least one transport position; and a cable interconnecting the first and second pull pin assemblies so that urging the cable simultaneously disengages both first and second pull pin assemblies from the respective first and second indexing plates, whereby the apparatus moves between the stow position and the at least one transport position.

2. The apparatus of claim 1, wherein each of the first pull pin assembly and the second pull pin assembly comprises a pull pin, a spring, and a pull pin housing.

3. The apparatus of claim 2, wherein each of the first indexing plate and the second indexing plate comprises one or more holes configured to receive the pull pin.

4. The apparatus of claim 3, wherein the cable is configured to engage or disengage the pull pin with the one or more holes, which enables the apparatus to move between the stow position and the at least one transport position.

5. The apparatus of claim 1, wherein each leg includes a pre-cut hole adjacent the proximal end, wherein the pre-cut hole is configured to attach to one of a ratchet strap, cord, or belt such that the ratchet strap, cord, or belt generates a clamping force that counteracts a weight of the apparatus when the ratchet strap, cord, or belt is pulled taught.

6. The apparatus of claim 1, wherein the at least one transport position comprises a first transport position and a second transport position, wherein in the first transport position each of the first and second legs are approximately perpendicular to a supporting surface of the watercraft, and wherein in the second transport position the first and second legs are disposed at a predefined angle in a range of 20-60 degrees relative to the supporting surface.

7. An apparatus for transporting a watercraft, the apparatus comprising:

a first leg and a second leg, wherein each leg comprises a proximal end and a distal end, wherein the first leg and the second leg are attached to a first transport component and a second transport component via respective distal ends;

a first indexing plate and a second indexing plate which are operatively associated with the proximal ends of respective first leg and the second leg and with the watercraft, wherein each of the first indexing plate and the second indexing plate comprises one or more holes;

a first pull pin assembly and a second pull pin assembly configured to engage or disengage with respective one or more holes to move the apparatus between a stow position and at least one transport position; and a cable interconnecting the first pull pin assembly and the second pull pin assembly so that urging the cable simultaneously disengages both first and second pull pin assemblies from the respective first and second indexing plates, whereby the apparatus moves between the stow position and the at least one transport position.

8. The apparatus of claim 7, wherein each of the first pull pin assembly and the second pull pin assembly comprises a pull pin, a spring, and a pull pin housing.

9. The apparatus of claim 7, wherein the cable is configured to engage or disengage the pull pin with the one or more holes, which enables the apparatus to move between the stow position and the at least one transport position.

10. The apparatus of claim 7, wherein the at least one transport position comprises a first transport position and a second transport position, wherein in the first transport position each of the first and second legs are approximately perpendicular to a supporting surface of the watercraft, and wherein in the second transport position the first and second legs are disposed at a predefined angle in a range of 20-60 degrees relative to the supporting surface.

* * * * *